US005895292A

United States Patent [19]

Affeltranger

[11] Patent Number: 5,895,292

[45] Date of Patent: Apr. 20, 1999

[54] MULTIPOLAR CONNECTOR SYSTEM WITH AN OUTLET AND AT LEAST ONE CONNECTOR FOR ELECTRICAL AND MECHANICAL CONNECTION OF ELECTRICAL CONDUCTORS

[75] Inventor: Walter Affeltranger, Eich, Switzerland

[73] Assignee: BKS Kabel Service AG, Derendingen, Switzerland

[21] Appl. No.: 08/862,258

[22] Filed: May 23, 1997

[30] Foreign Application Priority Data

May 23, 1996 [EP] European Pat. Off. ..... 96810332

[51] Int. Cl.[6] ..... H01R 9/03

[52] U.S. Cl. ..... 439/610; 439/701; 439/931

[58] Field of Search ..... 439/607, 609, 439/610, 931, 701

[56] References Cited

U.S. PATENT DOCUMENTS 5,342,221 8/1994 Peterson .

FOREIGN PATENT DOCUMENTS 0 037 013 10/1981 European Pat. Off. .

0 700 126 3/1996 European Pat. Off. .

*Primary Examiner*—Khiem Nguyen

*Attorney, Agent, or Firm*—Oblon, Spivak, McClelland, Maier & Neustadt, P.C.

[57] ABSTRACT

The connector system comprises an outlet and a single connector or a double connector. The single connector is suitable for connection of a service with four poles. The module of the outlet has four chambers, one pair of wires of the cable, shielded in pairs, being accepted per chamber. Two contact pins each are mounted per chamber of the module. The outlet comprises a base part and a cover. The single connector comprises a cover and a floor. Disposed in the housing, formed by the cover and the floor, are two guide bodies. The guide bodies each have two through holes in which sockets are provided for connection with the contact pins of the outlet. The guide bodies are provided with a shield on their part protruding beyond the housing, which shield is in contact with the inner wall of the chambers of the outlet. The ground connection is realized continuously throughout the connector system. The connector system is EMC-tight. With this connector system one or two services, as desired, can be connected, four wires of the eight-core cable of the outlet being used per service. The conductors extend essentially right through the connector system, which has an advantageous effect on the attenuation.

12 Claims, 8 Drawing Sheets

MULTIPOLAR CONNECTOR SYSTEM WITH AN OUTLET AND AT LEAST ONE CONNECTOR FOR ELECTRICAL AND MECHANICAL CONNECTION OF ELECTRICAL CONDUCTORS

BACKGROUND OF THE INVENTION

1. Field of the Invention

This invention relates to a multipolar connector system with an outlet and at least one connector for electrical and mechanical connection of electrical conductors.

2. Discussion of the Background

The connector system according to the invention is foreseen in particular for class E building cabling. The class determines the transmission quality of electrical signals of entire transmission lines or transmission systems from one terminal to another. In corresponding norms, such as EN 50173, limiting values are set down, for example, for the maximal cross talk attenuation, for the reflection loss, etc., as well as for the highest permissible frequencies. For class E and future classes, working with frequencies of up to 600 MHz and more is foreseen.

The trend in technical progress is that building cabling in the future will no longer be provided separately for telephones, electronic data processing devices, video devices, etc., but instead only a single building cabling network will be provided via which the information and data of all the services which come into question are transmitted. A start has been made with ISDN (Integrated Service Digital Network).

The building cabling usually provided for the aforementioned purpose comprises shielded cables with eight wires or four wire pairs, respectively, each with two twisted wires. However, at most four wires or two pairs of wires, respectively, are required per service. With the connector system preferably used today, which has become known by the type designation RJ 45, at most one connector for a single service can be plugged into an outlet. If two services are required at a place of work, two outlets have to be installed next to each other. This is rather time-consuming work since more than a single service is usually required nowadays at most places of work.

Moreover it has been discovered that the aforementioned electrical transmission parameters in the connector systems of the type RJ 45 are not suitable for frequencies of over 300 MHz, and desirable magnitudes can hardly be reached. Responsible for this is the internal connection technology having usually cut/clamp connections, the wires inside the outlet or the connector of this connector system being often run bent. Moreover it is known that in the case of the connector system RJ 45, the shielding of the individual pairs of wires is not led, or cannot be led, directly up to the connector contacts.

SUMMARY OF THE INVENTION

It is an object of the present invention to propose a connector system improved with respect to said state of the art. Achieved in particular should be that more than one service can be received at a single outlet.

A further object of the present invention is to improve the electrical transmission parameters with respect to the known connector system of the RJ 45 type and to make possible transmission frequencies of up to 600 MHz and higher. Another object is to propose an improvement in running the shielding inside the connector system, i.e. inside the outlet and inside the connector.

The object is attained with a multipolar connector system with an outlet and at least one connector for electrical and mechanical connection of electrical conductors wherein

- the outlet comprises an outlet housing which has a metallic surface on all sides;
- the outlet housing is divided into a plurality of individual, outwardly open chambers;
- at least one first connector contact, accessible from outside, is disposed in each of the chambers;
- the connector comprises a connector housing, which has a metallic surface on all sides;
- at least one second connector contact, accessible from outside, being disposed in the connector housing; and
- at least one connector per chamber can be plugged into the chamber of the outlet, the at least one first and the at least one second connector contacts connecting.

Special designs and solutions relating to the other objects will follow in the following description.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
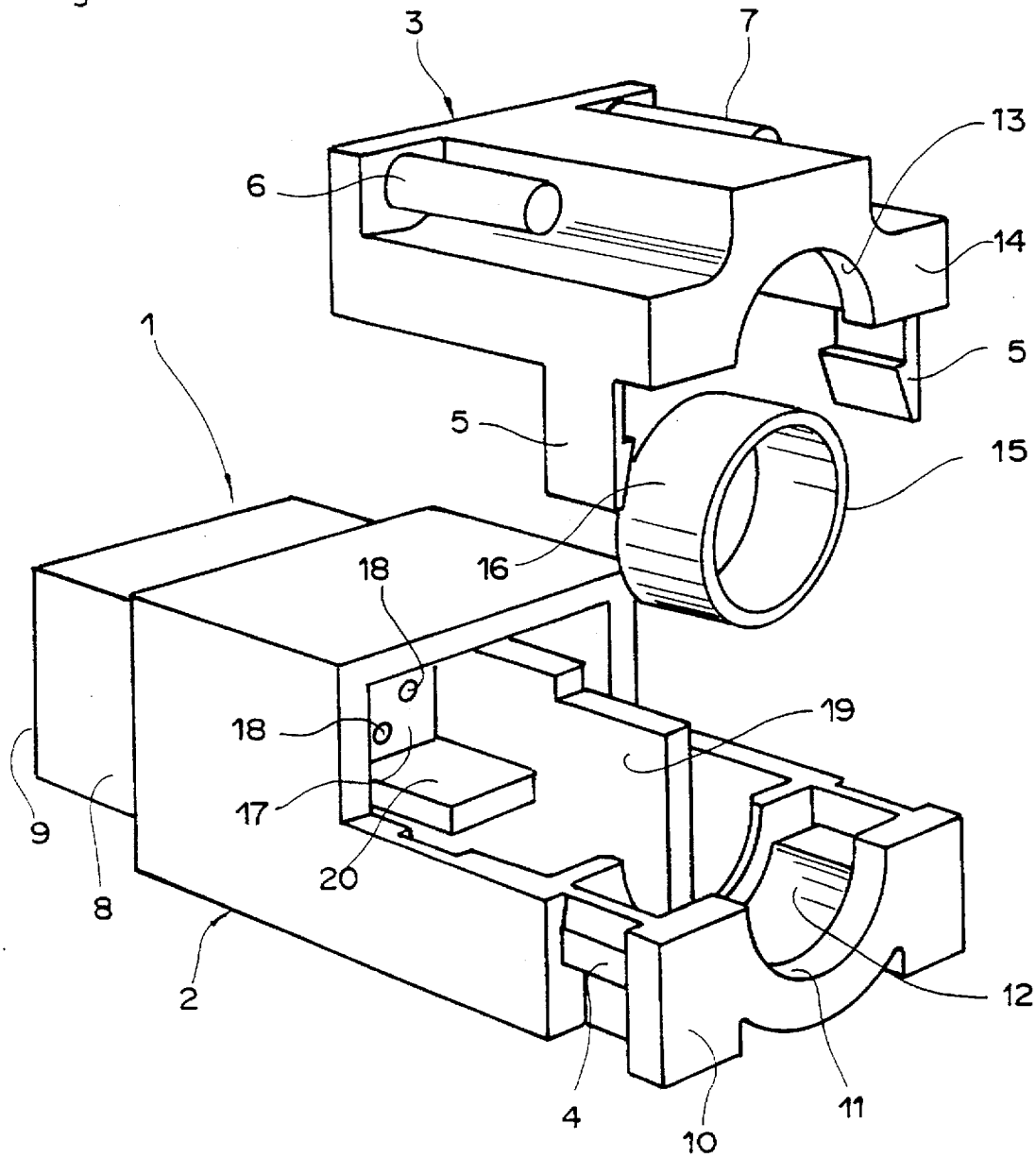
FIG. 1 is an exploded perspective view of an outlet.

Referring now to the drawings, wherein like reference numerals designate identical or corresponding parts throughout the several views, FIG. 1 illustrates an example embodiment of an outlet 1 according to the invention. In the exploded, perspective view of FIG. 1, the outlet, which is surrounded by a two-part outlet housing 2, 3 is shown in opened state, without cable. The two-part housing includes a base part 2 and a cover 3, which engages with the base part when placed thereon. Provided in addition are an engagement strip 4, essentially on each of the longitudinal sides of the base part, and one resiliently designed engagement tongue 5 on each of the longitudinal sides of the cover. Upon placement of the cover 3 on the base part 2, the engagement tongues engage over the engagement strips, whereby the cover is held firmly on the base part.

The two parts of the outlet housing 2, 3 are preferably made of plastic. They are produced in particular as injection-molded parts from a thermoplastic material. The two parts of the outlet housing are covered on all sides with a metal layer. The covering is made in a known way according to an electroplating process. A first covering comprises a copper layer, which conducts electricity well, and is intended for the electrical connection of a shield of a cable introduced into the outlet with an earth or ground connection 6,7, disposed on the outlet connection side, as will be described further on. The copper layer shields at the same time the outlet interior from electromagnetic fields. Applied over the copper layer is a nickel layer, intended above all for corrosion protection.

Inserted inside the outlet housing, in the base part 2, is a module 8 with connector poles. The module 8 has an insertion aperture 9, in which the outlet poles are accessible. Upon insertion of a corresponding connector counter-piece, these poles enter into an electrical connection with the socket connections of the counterpiece. The connector system has been categorized as class E, i.e. suitable for transmission of frequencies of up to 600 MHz and higher. The connector system is intended for cable of the type S/STP of category 6.

There is a semi-circular slot 12 joining a front side 10 of the base part 2 facing the cable which is to be connected with the connector. The cable insertion aperture 11 is disposed in this front side 10. The slot 12 extends at a right angle to the connector longitudinal axis. An identical semicircular slot 13 is provided joining a front side 14 in the cover 3 facing the cable to be connected with the outlet. When the cover 3 is placed on the base part 2 of the outlet housing, the slot 12, 13 is circular. Inserted in this slot is a ring 15, which serves the electrical connection of the shield of a cable with the earth or ground connection 6, 7. Like the other parts of the outlet, the ring 15 is preferably made of a metallized plastic. It is essential that the outer generated surface, designated 16, of the ring 15 conducts electricity well. This can be achieved in the case of a plastic ring by means of a metal covering, similar, for example, to that previously described. The slot 12, 13 is dimensioned in such a way that the ring has slight play both in its longitudinal axis and in the direction of its diameter.

The module 8 is provided with four plastic inserts 17, each one of which has two cylindrical through holes 18 disposed parallel to the longitudinal axis of the base part. Contact pins come to be situated in said holes 18. Connected to the module are a vertical partition 19 and a horizontal partition 20, between which will be situated one shielded pair of wires each of the connecting cable.

Figure 2:
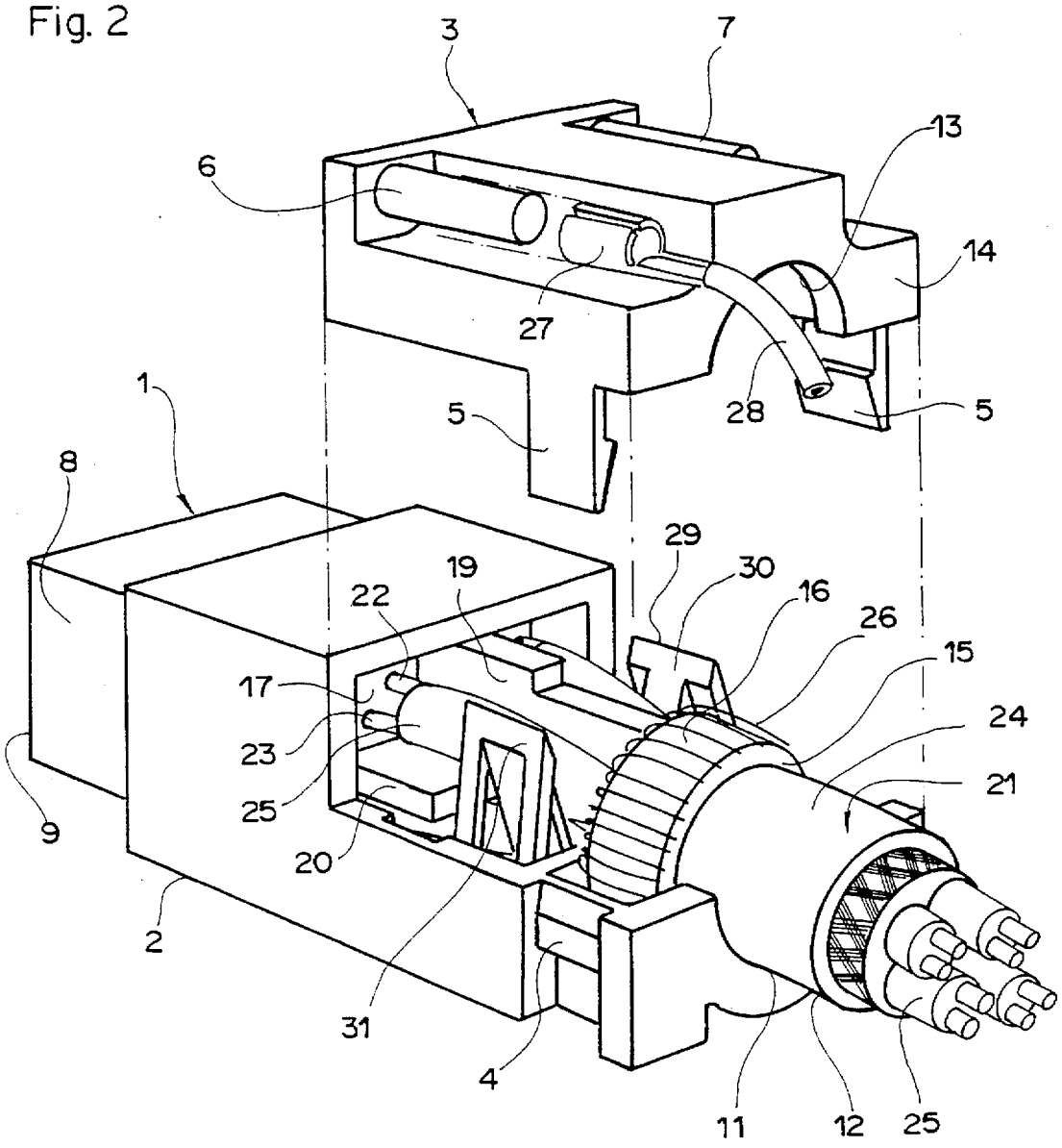
FIG. 2 is an exploded perspective view of an outlet with cable connected.

Shown in FIG. 2 is another exploded, perspective view of an outlet, however with cable connected. The cable 21, which is to be connected to the outlet, comprises a plurality of wires 22, 23, eight in the example shown, which run twisted in pairs through a cable sheath 24. Two twisted wires in each case are shielded by an inner shield 25. An outer shield 26 of wire mesh is positioned to enclose completely all the wires. To connect the outlet to the cable 21, the sheath 24 of the cable is removed in an end area. From the end of the sheath, the twisted wires are exposed with the inner shield. The ring 15, which has been pushed been over the sheath beforehand, is now disposed in such a way that it comes to lie in the area of the sheath end, the wire mesh of the outer shield 26 being placed over the outer generated surface 16 of the ring 15. The outer generated surface 16 of the ring 15 should be covered by the wire mesh of the outer shield 26 as evenly as possible over the entire circumference of the ring. The ring 15 lies in the slot 12 of the base part 2 with the wire mesh of the outer shield 26 inverted over it. The play between the slot and the ring is such that just enough space remains to accept the shield. When the cover 3 is placed on, the ring 15 is situated in the now circular slot 12, 13 together with the wire mesh of the outer shield 26 of the cable 21 inverted over its outer generated surface 16. Distributed over the entire circumference of the slot 12, 13, the shield 26 abuts the end surfaces and the generated surface of the slot 12, 13. The metal covering of the outlet housing 2, 3 acts as a contact element or an electrical contact path, respectively, to produce an electrical connection between the ring 15, the shield 26 and the outlet housing 2, 3, or the connecting tongues 6, 7 in particular, which are disposed on the exterior of the cover for the earth or ground connections. The slot 12, 13 holds the ring 15 stationary with respect to the longitudinal axis of the outlet. The slot 12, 13 acts as a connecting element for the ring 15. Thus the slot not only establishes an electrical contact between the shield and the connecting tongues 6, 7, but is also responsible, together with the ring, for the stress relief of the cable 21. The cylindrically designed earth connections 6, 7 are intended to receive connecting plugs, in particular round sleeves 27, to which the earth or ground wires are connected. Further provided in the base part 2 is an insert 29, which, with two flaps 30 and 31, establishes the contact between the inner shields 25 of the wires 22, 23 and the base part 2.

Figure 3:
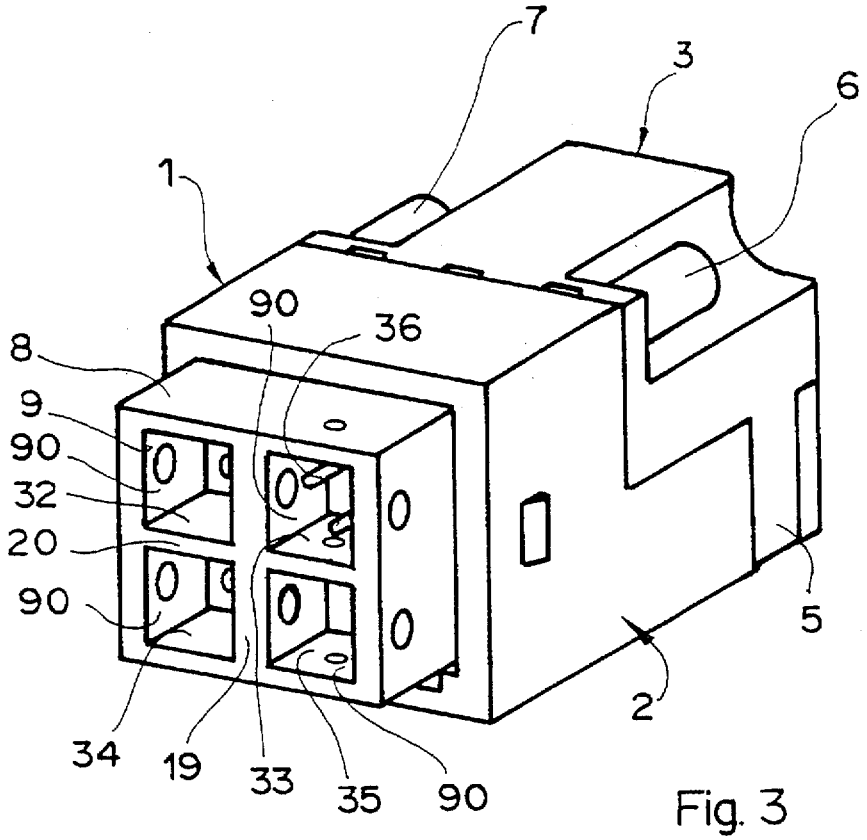
FIG. 3 is a perspective view of an outlet seen from the front.

The outlet is shown in a perspective view in FIG. 3. The module 8 of the outlet has four chambers 32, 33, 34 and 35, it being possible to accept one pair of wires of the cable, shielded in pairs, per chamber. Two contact pins 36 each are mounted per chamber of the module 8, as will be explained further below. The inner chamber walls 90 serve to establish the contact with the connector.

Figure 4:
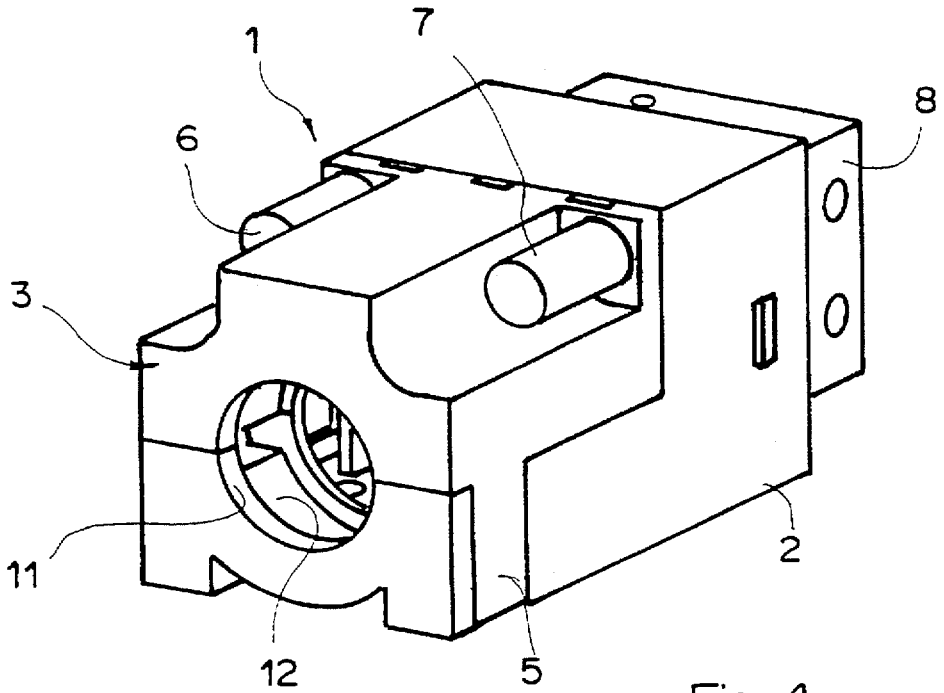
FIG. 4 is a perspective view of an outlet seen from behind.

The outlet is shown, seen from the rear, in a perspective view in FIG. 4.

Figure 5:
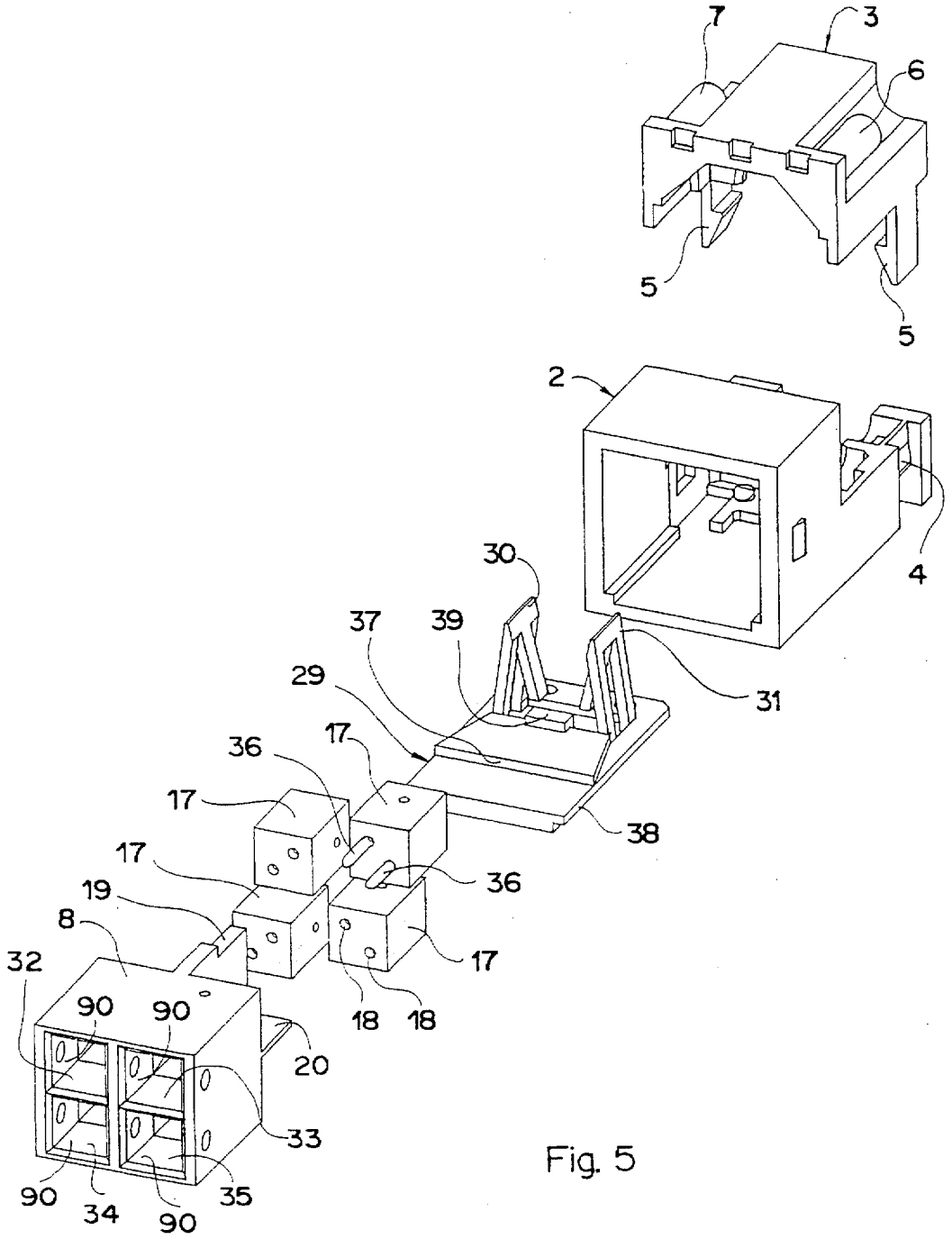
FIG. 5 is an exploded perspective view of an outlet seen from the front.

Shown in FIG. 5 is an exploded perspective view of the outlet, as seen from the front side. Four plastic inserts 17 are fitted into the four chambers 32, 33, 34 and 35 of the module 8. The plastic inserts 17 have two through holes 18 each on a diagonal line. Inserted into the through holes 18 are contact pins 36, the eight wires of the cable being attached to their backs. The arrangement of the two contact pins 36 each in the four chambers is such that a protection against reversing poles is achieved. The connector of a service can be plugged in only a single position. The insert 29 serves, on the one hand, to establish the contact between the inner shields and the housing, and, on the other hand, as a stop device for the module 8 in the base part 2. This stopping takes place by means of a step 37 in the floor 38 of the insert 29. When the outlet is assembled, a recess in the lower edge of the vertical partition 19 engages with a projection 39 on the insert 29.

Figure 6:
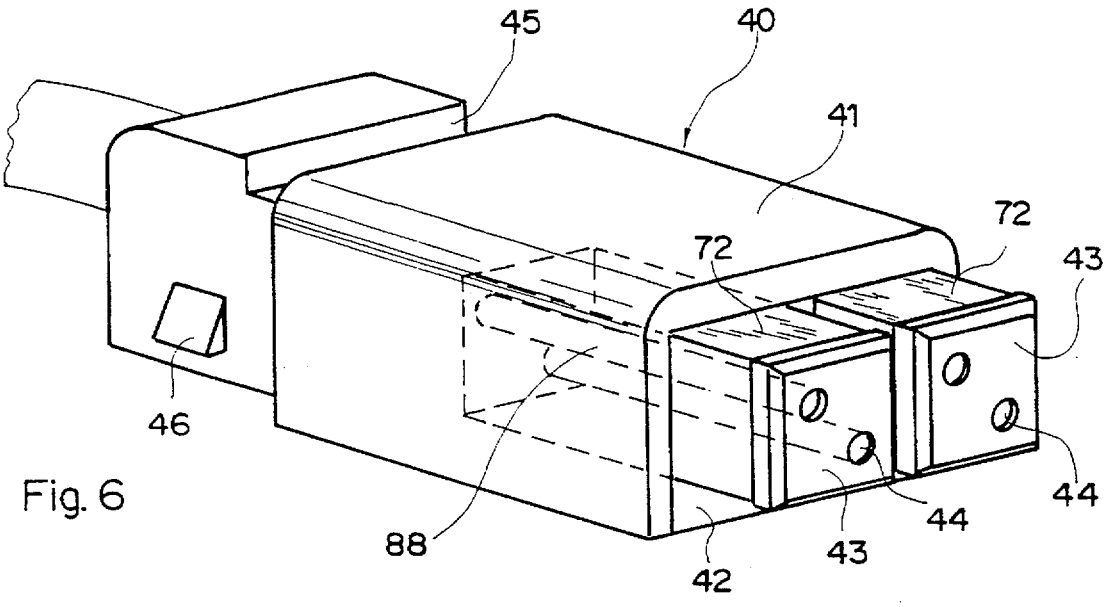
FIG. 6 is a perspective view of a single connector seen from the front.

FIG. 6 shows in a perspective view a single connector, in which the plug sockets 88 are accommodated. The connector 40 is suitable for connection of one service. It comprises a cover 41 as well as a T-shaped piece 42, which serves as floor. The cover 41 and the floor 42 form the housing. The guide bodies 43 which extend through the connector, are provided with through holes 44, which lie on a diagonal and in which the sockets 88 are disposed. The diagonals on the two guide bodies 43 on which the holes 44 are situated, are parallel. Provided in the rear end of the cover are a slot 45 and two toes 46 for holding a protection against kinks for the cable 47. The parts of the single and double connector are preferably made of plastic. They are made in particular of a thermoplastic material as injection-molded parts and are covered with a metal layer on all sides, and in other respects are made the same way as the parts of the outlet.

Figure 7:
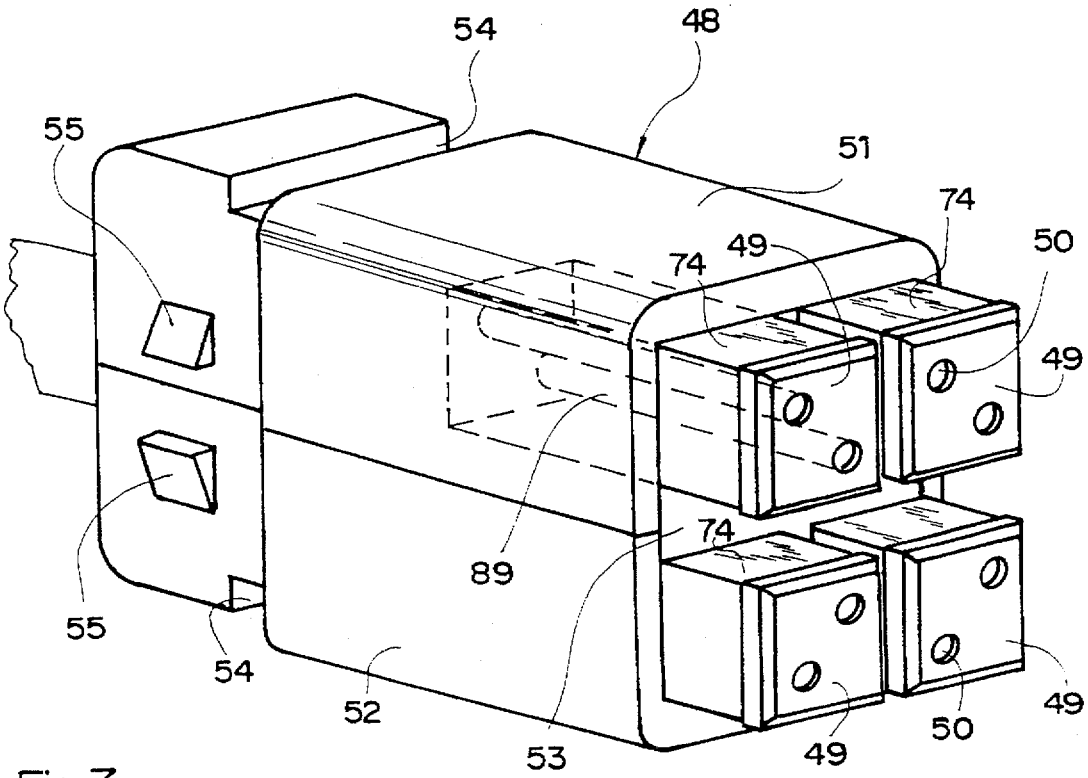
FIG. 7 is a perspective view of a double connector seen from the front.

Shown in FIG. 7 is a perspective view of a double connector 48, which is suitable for connecting a service with four pairs of wires to the outlet. The connector has four guide bodies 49, which correspond to those of the single connector. The through holes 50 are likewise disposed on a diagonal, whereby the diagonals on which the through holes lie, of the upper two guide bodies and of the lower two guide bodies are situated at right angles to each other. Sockets 89 are disposed in the through holes 50. Disposed between the two identically designed covers 51 and 52 is a double-T shaped central piece 53. In the rear part of the connector there are two slots 54 and four toes 55 for mounting of a protection against kinks for the cable.

Figure 8:
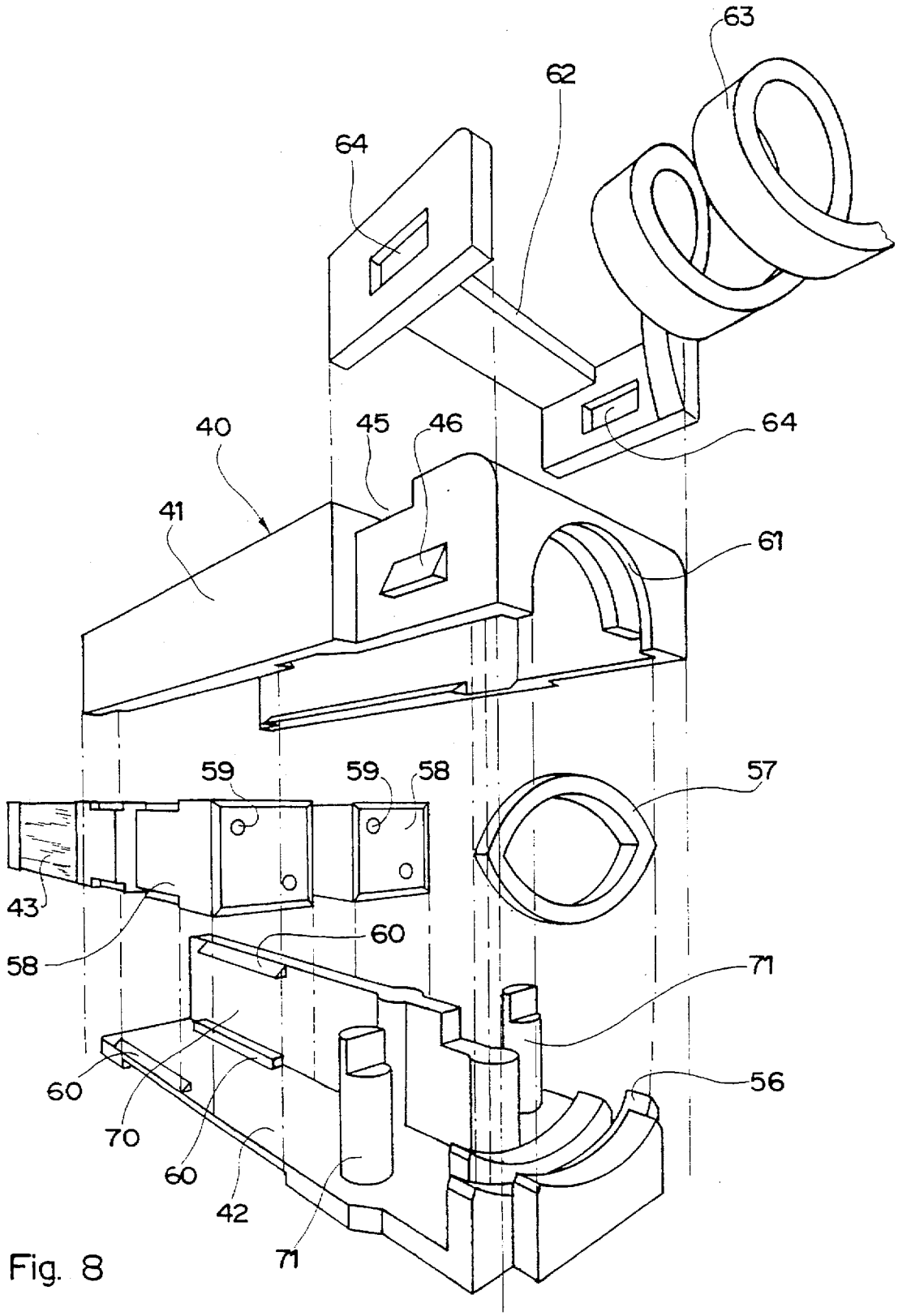
FIG. 8 is an exploded perspective view of a single connector.

Shown in FIG. 8 in an exploded perspective view is a single connector 40. The floor 42 has a central crosspiece 70 and bolts 71 disposed on either side of this crosspiece. An arcuate slot 56 in the back side end of the connector serves the purpose of accepting a ring 57. In the back side part of the connector, connecting pieces 58 are placed on the guide bodies 43. These pieces 58 are also provided with through holes 59. The connecting pieces 58 are connected to the guide bodies 43 with bolts, not visible in this figure. On both sides of the central crosspiece 70 the floor 42 of the connector is provided with ridges 60 which hold the guide body 43. The cover 41 is provided with a semicircular slot 61 for accepting the ring 57. A holder 62 with a kink protection 63 is mounted in the slot 45 of the cover 41, recesses 64 on the holder 62 engage with the toes 46 provided on the cover.

Figure 9:
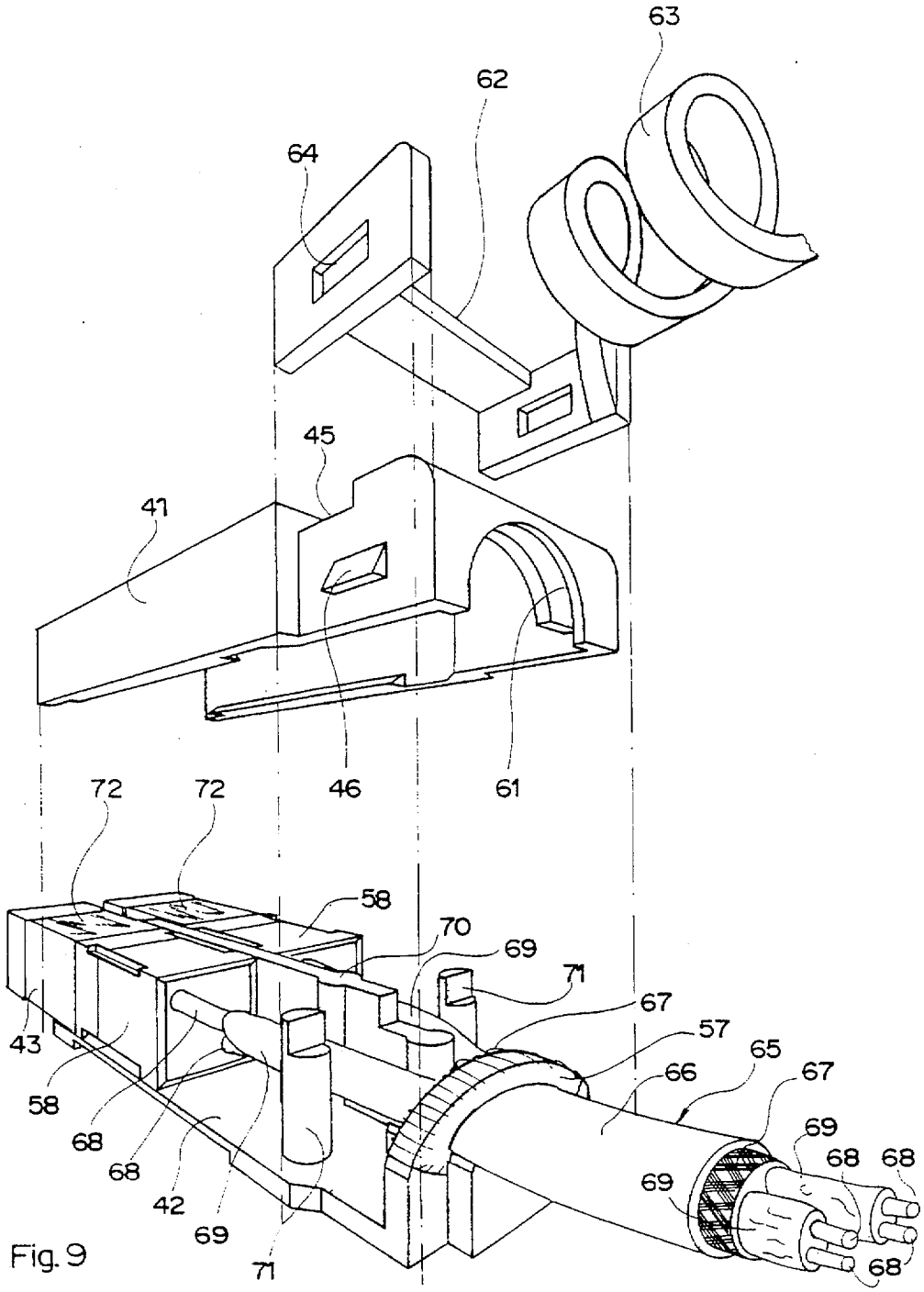
FIG. 9 is an exploded perspective view of a single connector with cable connected.

Shown in FIG. 9 in an exploded perspective view is the single connector with cable 65 connected. The guide bodies 43 are provided with beryllium bronze 72 which has contact with the housing 41, 42 and exercises the function of a shield for the parts of the guide bodies 43 projecting over the housing. The cable 65 is provided with an external shield 67 under its outer insulation sheathing 66. The shield 67 consists of wire mesh. Before the cable is connected to the connector, part of the sheathing 66 of the outer shield 67 is removed. The part of the shield 67 protruding beyond the sheathing is inverted over the ring 57, establishing contact of the outer shield with the housing 41, 42. Both the housing and the ring 57 are metallized, as in the case of the outlet. Two wires 68 each of the cable are twisted together and are provided with an inner shield 69. The inner shield 69 is clamped in each case between the central crosspiece 70 and one bolt 71 so that contact of the inner shield 69 with the housing 41, 42 is established.

Figure 10:
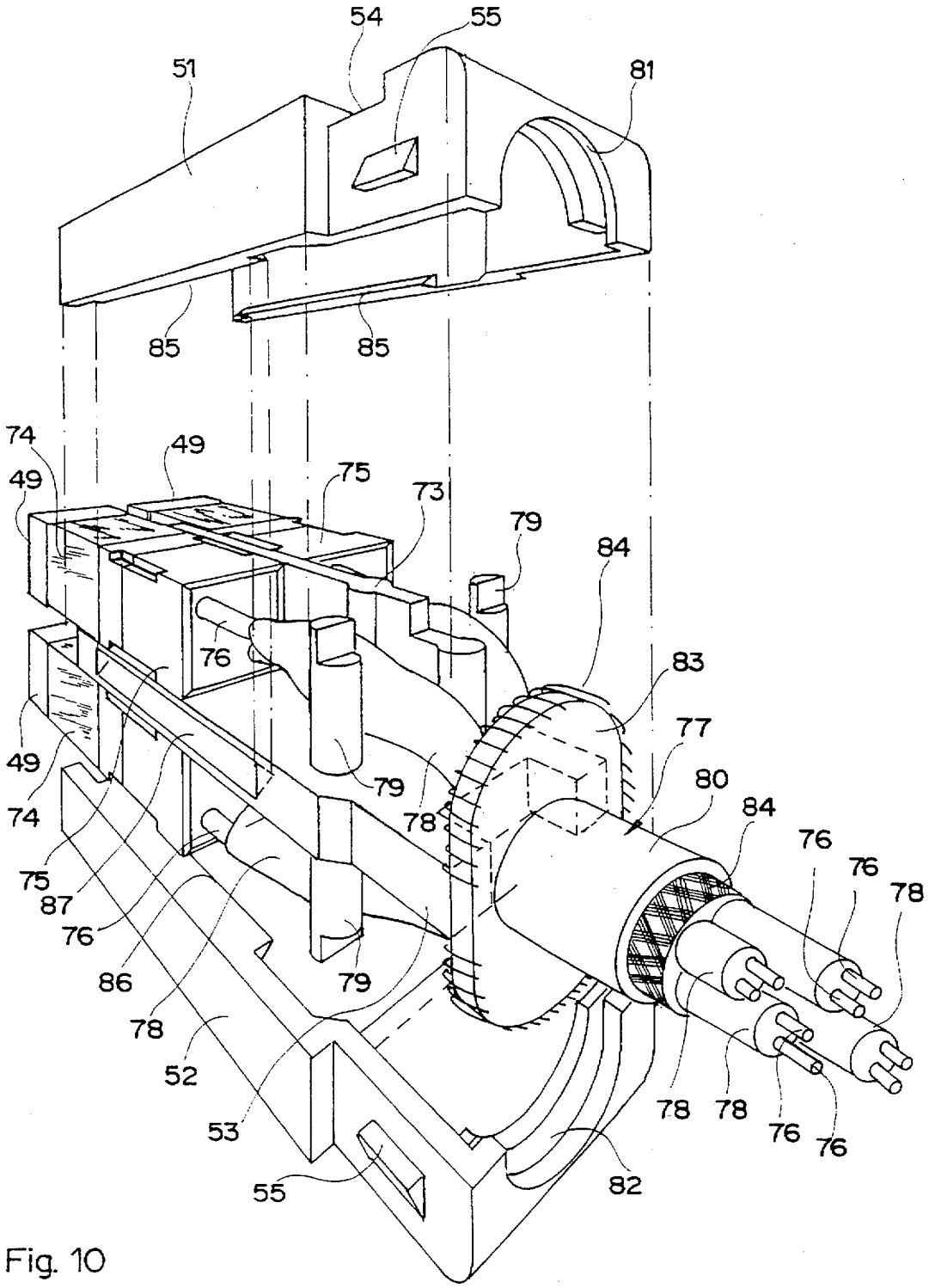
FIG. 10 is an exploded perspective view of a double connector with cable connected.

Shown in FIG. 10 in an exploded perspective view is the double connector with cable connected. The connector corresponds to that according to FIG. 7. The central piece 53 has two ribs 73 extending upward and downward. Four guide bodies 49 are provided, which are disposed on both sides of the central piece 53. The guide bodies 49 are also provided with beryllium bronze 74, so that the parts of the guide bodies 49 protruding beyond the housing 51, 52 are shielded. Here connecting pieces 75 are likewise placed on the guide bodies 49 with bolts not visible in this figure. Two sockets 89 each are disposed in the through holes 50 in the guide bodies 49. The exposed wires 76 of the cable 77 are led into the connecting pieces 75. The wires with the inner shield 78 are each clamped between a bolt 79 and the central crosspiece 73 in order to achieve a good contact to the housing 51, 52. The cable 77 is constructed in principle the same way as cable 65 according to FIG. 9, with the difference that there are four twisted pairs of wires. Each pair of wires 76, 76 has an inner shield 78, all four pairs of wires being surrounded by one outer shield 84. Outermost is the insulating sheathing 80. A semicircular slot 81 or 82, respectively, is made in each of the cover parts 51 and 52. Fitted into these two slots is an annular plate 83. The mesh 84 of the exposed outer shield is placed around the plate 83 in order to establish a contact between the outer shield 84 and the housing 51, 52. Projections 85 in the upper cover part 51 and projections 86 in the lower cover part 52 lock into position in the slots 87 in the central piece 52 when the connector is assembled.

One or two services, as desired, can be connected with the connector system according to the invention, per service two or four pairs of wires of the eight-core cable of the outlet being used. For one or two services with two pairs of wires, one or two single connectors 40 is/are used, and for a service with four pairs of wires a double connector 48 is used. With the connector system according to the invention, the ground connection is continuously realized. A shielding led through the entire outlet or the entire connector prevents cross talk or side-to-side cross talk from occurring with high frequencies. The connector system is designed as a four-chamber system with four metallized chambers 32, 33, 34, 35, one pair of wires 22, 23, 68, 76 of the cable, shielded in pairs, being accepted per chamber. By means of this construction and as a result of the continuous grounding, the connector system is EMC-tight. Because of the high frequencies the connector system is of radial design with contact segments. A straight passage of the conductors through the connector system is thereby achieved, which has an advantageous effect on the attenuation. Contrary to the usual norm, the contact pins 36 are disposed in the outlet 1, and the contact sockets are accommodated in the connector 40, 48. Better protection of the contact pins is achieved by means of this reversed arrangement. Through the arrangement on a diagonal of two contact pins each in the four chambers, a protection against reversing poles is achieved. The connector of a particular service can only be inserted in a single position.

What is claimed is:

1. A multipolar connector system with an outlet and at least one connector for electrical and mechanical connection of electrical conductors wherein:

the outlet comprises an outlet housing which has a metallic surface on all sides;

the outlet housing is divided into a plurality of individual, outwardly open chambers;

two first connector contacts, accessible from outside, are disposed in each of the chambers;

the at least one connector comprises a connector housing, which has a metallic surface on all sides;

at least two guide bodies are disposed in the connector housing;

two second connector contacts, accessible from outside, are disposed in each of the at least two guide bodies; and one of the at least two guide bodies per chamber is engageable in the chamber of the outlet, so that the two first and the two second connector contacts connect, wherein for connection of multi-core cables, each wire of the cable is led and connected inside the outlet essentially in an axial direction of the two first connector contacts, and each wire of another cable is led and connected inside the connector essentially in an axial direction of the two second connector contacts; and wherein the connectable cables are shielded cables which have a first shield under a cable sheathing, the shield enclosing all wires of the cable, each two wires twisted together of the cable are enclosed with a second shield, the second shield is led inside the outlet housing directly up to the two first connector contacts, and the second shield of another cable is led inside the connector housing directly up to the two second connector contacts.

2. The connector system according to claim 1, wherein there are four of said chambers, the chambers being disposed in pairs next to one another and over one another.

3. The connector system according to claim 2, wherein the two first connector contacts are disposed in the chambers of the outlet, and the corresponding two second connector contacts are disposed in the connectors in such a way that one of the connectors is engageable in two specific, associated chambers only.

4. The connector system according to claim 1, wherein all first connector contacts, which are disposed in the outlet, are contact pins, and the second connector contacts, which are disposed in the connectors, are contact sockets.

5. The connector system according to claim 1, wherein said at least two guide bodies projecting into the associated chamber of the outlet housing when the connector is plugged in, and is led through an inner chamber wall, and the at least two guide bodies have a generated surface which is at least partially covered with a metallic shield, the surface establishes an electrical contact with said metallic inner chamber wall of the outlet housing.

6. The connector system according to claim 1, wherein a single connector with two guide bodies is used for connection of a service with two pairs of wires to the.

7. The connector system according to claim 1, wherein two single connectors are used for connection of two services with two pairs of wires each to the outlet.

8. The connector system according to claim 1, wherein a double connector with four guide bodies is used for connection of a service with four pairs of wires to the outlet.

9. The connector system according to claim 5, wherein the connector is provided with four guide bodies.

10. The connector system according to claim 5, wherein two connectors can be combined, with holding means, into a single connector.

11. The connector system according to claim 1, wherein the outlet is provided with led-out and prolonged connector contacts for direct mounting on a printed circuit board.

12. The connector system according to claim 1, for cabling inside buildings for transmissions of signals with frequencies of up to 600 MHZ and higher.

* * * * *